US005600912A

United States Patent [19]

Smith

[11] Patent Number: 5,600,912

[45] Date of Patent: Feb. 11, 1997

[54] COMPOSITE TUBE FOR A GUN BARREL

[76] Inventor: David B. Smith, 614 E. 22nd St., Vancouver, Wash. 98663

[21] Appl. No.: 564,787

[22] Filed: Nov. 29, 1995

[51] Int. Cl.[6] ..... F41A 21/02

[52] U.S. Cl. ..... 42/76.01; 42/76.02; 89/16; 29/1.1; 29/1.11

[58] Field of Search ..... 42/76.01, 76.02; 29/1.1, 1.11; 89/16

[56] References Cited

U.S. PATENT DOCUMENTS

| | | | |
|---|---|---|---|
| 4,641,450 | 2/1987 | Moll et al. | 42/76.02 |
| 4,685,236 | 8/1987 | May | 42/76.02 |
| 4,729,806 | 3/1988 | Stein | 156/172 |
| 5,125,179 | 6/1992 | Campbell et al. | 42/76.02 |

*Primary Examiner*—J. Woodrow Eldred
*Attorney, Agent, or Firm*—Chernoff, Vilhauer, McClung & Stenzel, LLP

[57] ABSTRACT

A composite tube for a gun barrel and a method for making the tube are disclosed. The tube includes a plurality of elongate carbon fibers and a resin material surrounding a longitudinal bore axis. The elongate carbon fibers are aligned parallel with the longitudinal bore axis and are under compression along the longitudinal bore axis. Such a tube for a gun barrel may be made by wrapping a tubular metal liner with a resin matrix material containing a plurality of elongate carbon fibers, and aligning the carbon fibers parallel with the longitudinal axis of the liner. The resin matrix material is cured, and the elongate carbon fibers are placed under compression along the longitudinal axis of the liner. Compressing the carbon fibers along the longitudinal axis of the liner produces a tube of surprising stiffness. The tube provides a highly stable gun barrel of reduced weight for good accuracy.

22 Claims, 1 Drawing Sheet

COMPOSITE TUBE FOR A GUN BARREL

BACKGROUND AND SUMMARY OF THE INVENTION

This invention relates to a composite tube for a gun barrel and more particularly to a composite tube including carbon fibers and a resin matrix material, and a method for constructing such a tube.

Composite gun barrels are desirable because they permit the construction of lightweight firearms. A composite barrel such as one constructed from a tube made of carbon fiber and epoxy resin materials, however, typically lacks sufficient stiffness to maintain its integrity for accurate reproducible firing. Even when the composite barrel includes an inner tubular liner, a firearm having such a composite barrel tends to be less accurate than a firearm having a conventional barrel.

Gladstone et al., U.S. Pat. No. 4,646,615, disclose a gun barrel produced by first filling the longitudinally-extending channels in a mandrel with rovings of an epoxy resin-impregnated carbon fiber and then wrapping the resin-impregnated carbon fiber around the mandrel in both hoop-wound and helically-wound layers.

Friar et al., U.S. Pat. No. 5,054,224, disclose an apparatus and method for producing a disposable composite gun tube by winding a resin-impregnated carbon filament fiber around a mandrel in alternate helical and hoop wraps.

May, U.S. Pat. No. 4,685,236, discloses a gun barrel constructed with an inner tubular liner and an outer jacket of a helically wound carbon fiber-reinforced metal matrix material.

Stein, U.S. Pat. No. 4,729,806, discloses a method for the manufacture of a composite tube by first applying pressure to a metal liner blank in a pressure chamber to impart an even thickness to all parts of the liner wall, and thereafter wrapping the exterior of the liner with a resin-impregnated fiber material.

Oskarsson et al., U.S. Pat. No. 5,191,165, disclose a method of producing a rifled, non-metallic barrel of composite material by first coating a mandrel with a continuous fluffy fiber mat, drenching the mat with a resin, and then surrounding the resin-drenched fiber mat with a plurality of resin-impregnated fiber layers disposed peripherally about the mandrel.

None of these references discloses, however, a composite tube for a gun barrel with sufficient bore stiffness for accurate reproducible firing.

Thus, a need exists for an improved composite tube for a gun barrel that overcomes the problems of prior composite tubes.

According to one aspect of the present invention, such a need is satisfied by a tube for a gun barrel defining a longitudinal bore axis, including a plurality of elongate carbon fibers and a resin material surrounding the longitudinal bore axis. The elongate carbon fibers are aligned parallel with the longitudinal bore axis and are under compression along the longitudinal bore axis.

According to another aspect of the present invention, such a tube for a gun barrel is made by wrapping a tubular metal liner with a resin matrix material containing a plurality of elongate carbon fibers, and aligning the carbon fibers parallel with the longitudinal axis of the liner. The resin matrix material is cured, and the elongate carbon fibers are placed under compression along the longitudinal axis of the liner.

Compressing the carbon fibers along the longitudinal axis of the liner produces a tube of surprising stiffness. Thus, it is possible to produce a gun barrel of reduced weight with maximum projectile control and stabilization but minimal deformation, which is essential for maximum accuracy.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
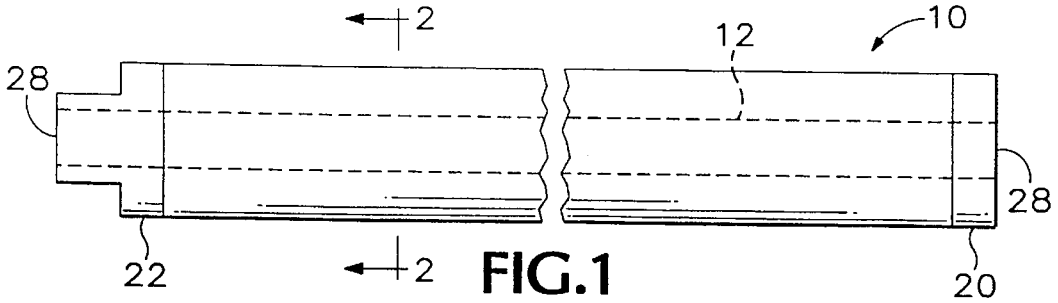
FIG. 1 is a representation of a composite tube for a gun barrel embodying the present invention.
Figure 3:
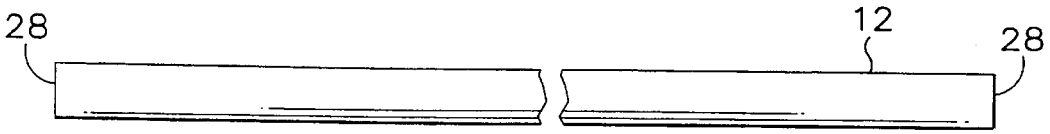
FIG. 3 is a representation of a metal liner appropriate for use in the present invention.

Referring now to an exemplary embodiment illustrated in FIGS. 1–5, a composite tube 10 for a gun barrel for a rimfire firearm (FIG. 2) includes an inner thin-walled tubular liner 12 forming a rifled bore 14, and a resin matrix material 16 containing a plurality of elongate continuous carbon fibers 18 surrounding the liner. The carbon fibers 18 are aligned parallel with the longitudinal bore axis of the liner 12 and are compressed along the longitudinal bore axis between a muzzle piece 20 and a breech piece 22 (FIG. 1). The compressed carbon fibers impart torsional resistance and stiffness to the tube.

The liner 12 which forms the bore 14 may be made of any suitable material, typically steel, such as a chrome moly steel or stainless steel, or other metal. The liner material is selected to resist projectile-induced erosion and to withstand the stresses and heat generated in the barrel made from the tube when the firearm is fired.

Figure 4:
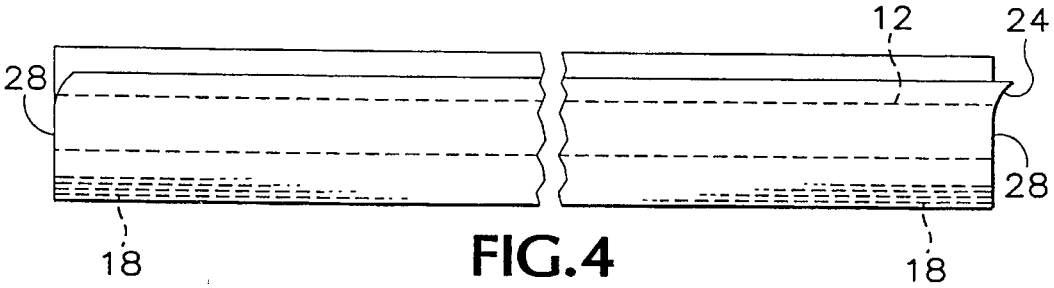
FIG. 4 is a representation of the liner of FIG. 3 shown with a wrap of a resin matrix material containing a plurality of carbon fibers.
Figure 5:
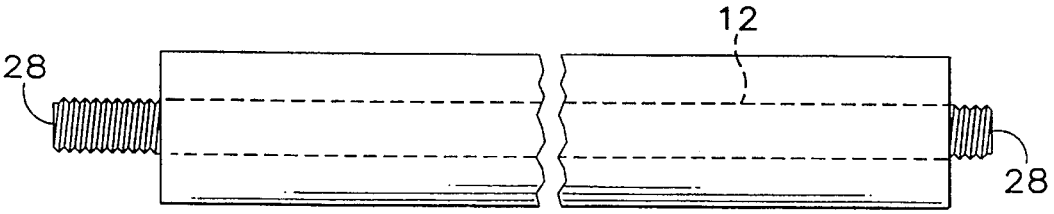
FIG. 5 is a representation of the liner shown in FIG. 4 with the ends of the liner exposed and prepared for receiving end pieces.
Figure 2:
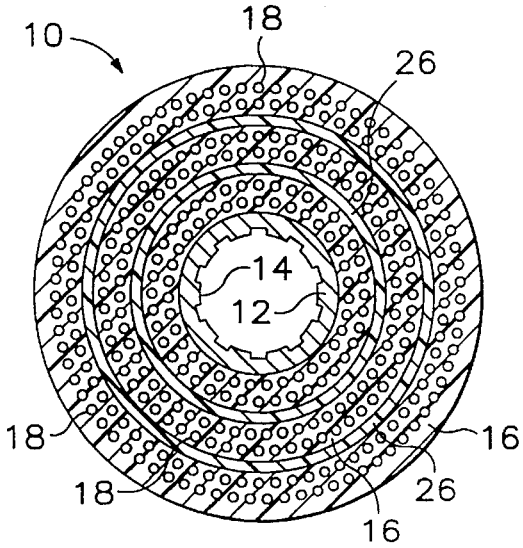
FIG. 2 is an enlarged sectional view taken along line 2—2 of FIG. 1.

The resin and fibers are combined in a fiber-containing resin matrix mat 24, for example, 0.005–0.010 inch thick, so that the carbon fibers are aligned generally parallel to each other with each fiber extending generally the width of the mat (FIG. 4). The resin is preferably an epoxy resin such as resin No. 949, supplied by ICI Fiberite of Tempe, Ariz. The carbon fiber is preferably graphite such as graphite fiber Code 10G Torayca T-300 (12K) untwisted, UC-309 sized, having a density of 1.72–1.81 g/cc and a tensile strength of 500 ksi, also supplied by ICI Fiberite.

To construct a stiff composite tube such as the tube 10 suitable for the gun barrel of a rimfire firearm (FIG. 2), the thin-walled tubular liner 12 (FIG. 3) is wrapped with a layer of the mat 24 (FIG. 4) so that the elongate carbon fibers 18 are aligned parallel with the longitudinal axis of the liner. Each carbon fiber 18 thus extends generally the length of the liner 12. Successive layers of the mat 24 of resin matrix material and fibers are similarly applied to the liner 12.

After applying about five layers of the mat 24 to the liner 12, a layer 26 of a polymer such as polypropylene is applied to compress and secure the previously-applied layers of the fiber-containing resin matrix mat. For example, a polypropylene tape is applied in a tight spiral wrap. Preferably, the polymer layer is applied with sufficient pressure to force a portion of the resin from the previously-applied layers out of the mats and thus to decrease and minimize the interval between adjacent carbon fibers. The outside diameter of the tube is thus increased by adding successively about five layers of the mat 24 followed by a layer 26 of the polymer. Additional layers of the mat 24 and of the polymer are applied until the composite tube approaches the desired outside diameter. At least one layer of the resin material alone, that is, without any carbon fibers, is applied to the composite tube to provide an outer layer which may be polished. When the tube has reached the desired outside diameter the resin matrix is cured, for example by heating the tube to a temperature sufficient to process and cure the resin matrix.

After the resin has been cured, the tube is prepared for the end pieces. A portion of the cured fiber-containing resin matrix mat material is removed proximate each of the two ends 28 of the liner 12. The liner, proximate the ends 28, is then adapted (FIG. 5) to receive an appropriate breech piece 22 and a muzzle piece 20. As shown, the breech piece 22 and muzzle piece 20 may be threadedly attached to the ends of the liner 12 or they may be otherwise appropriately attached, for example, with an epoxy adhesive. The muzzle piece 20 and the breech piece 22 are attached to the liner 12 to compress the elongate carbon fibers 18 and the cured resin matrix material 16 along the bore axis. The end pieces provide sufficient compression to stiffen the fibers and to generally eliminate their resilience.

Figure 6:
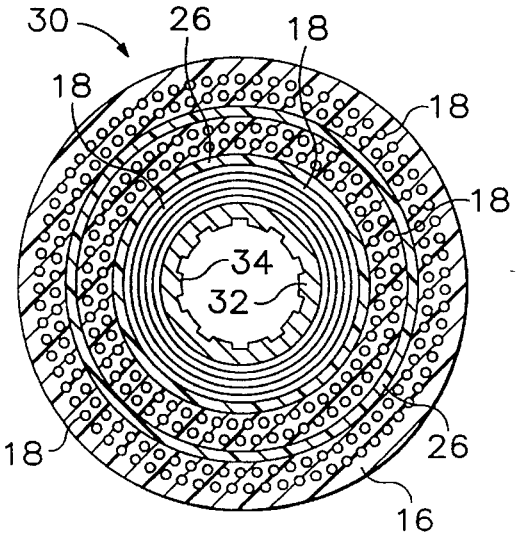
FIG. 6 is a sectional view of a representation of an alternative embodiment of a composite tube for a gun barrel embodying the present invention.

In a second preferred embodiment, a composite tube 30 for a gun barrel for a center fire firearm includes an inner tubular liner 32 forming a rifled bore 34 (FIG. 6). The liner 32 is wrapped with the mat 24 of the resin matrix material 16 containing a plurality of elongate carbon fibers 18 as described above for a rimfire firearm. In addition, a minimum number of layers of the resin matrix material 16 containing a plurality of elongate carbon fibers 18 are wrapped onto the liner 32 in a hoop wrap so that the carbon fibers, which are generally parallel to each other, are aligned in a direction 90° to the longitudinal bore axis. The hoop wraps provide the additional strength necessary to contain the elevated pressures encountered in the barrel of a center fire firearm. These hoop wraps are preferably the layer or layers immediately adjacent the liner. The hoop wraps are secured with a layer 26 of a polymer such as polypropylene. After the hoop wraps, additional layers of the fiber-containing resin matrix mat 24 are wrapped onto the liner with the elongate carbon fibers 18 aligned parallel with the longitudinal bore axis of the liner as previously described for tube 10. The outside diameter of the tube 30 is increased by wrapping successively onto the liner about five layers of the mat followed by a layer of the polymer, as described above. When the tube 30 has achieved the desired outside diameter the resin matrix material 16 is cured and the liner is prepared to receive appropriate muzzle and breech end pieces. The end pieces are applied to the liner 30 to compress the longitudinally aligned carbon fibers 18 as previously described for the tube 10.

A 19-inch tube for a Ruger 10/22 barrel produced according to the present invention weighs 13.76 oz, compared, for example, to an 18-inch Volquartsen stainless steel Ruger 10/22 barrel which weighs 3 lbs 6 oz. When test fired for accuracy, the 19-inch Ruger 10/22 barrel produced a 10-shot grouping of 0.351 inch when fired at 50 yards from bench rest using a 36X scope. This accuracy was attained at an outdoor range with match quality ammunition.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of making a stiff composite tube for a gun barrel, comprising:

(a) wrapping a tubular metal liner with a resin matrix material containing a plurality of elongate carbon fibers;

(b) during step (a), aligning said carbon fibers parallel with the longitudinal axis of said liner;

(c) curing said resin matrix material; and (d) placing said elongate carbon fibers in compression along the longitudinal axis of said liner.

2. The method of claim 1 wherein said resin matrix material is cured by heating.

3. The method of claim 1 wherein multiple layers of said resin matrix material are wrapped onto said liner.

4. The method of claim 3, including the step of wrapping said multiple layers with a layer of polypropylene.

5. The method of claim 4 wherein said layer of polypropylene is applied with sufficient pressure to force a portion of said resin matrix material from said multiple layers.

6. The method of claim 1, including the step of wrapping a layer of said resin matrix material so that said carbon fibers are aligned parallel to each other in a direction 90° to the longitudinal axis of said liner in a hoop wrap.

7. The method of claim 1 wherein step (d) includes attaching a muzzle piece and a breech piece to opposite ends of said liner to place said carbon fibers in compression.

8. The method of claim 1, including, prior to step (d), exposing the ends of said liner.

9. A gun barrel, comprising:

(a) an inner tubular metal liner defining a longitudinal bore axis; and (b) a resin matrix material surrounding said liner, said resin matrix material containing a plurality of elongate carbon fibers;

(c) said elongate carbon fibers being aligned parallel with said longitudinal bore axis of said liner, and under compression along said longitudinal bore axis.

10. The gun barrel of claim 9 wherein said liner has a breech end and a muzzle end, said gun barrel including a muzzle piece attached to said muzzle end of said liner and a breech piece attached to said breech end of said liner to compress said carbon fibers.

11. The gun barrel of claim 9 wherein said resin matrix material comprises a plurality of layers.

12. The gun barrel of claim 11, including at least one layer of a polymeric material.

13. The gun barrel of claim 12 wherein said polymeric material is polypropylene.

14. The gun barrel of claim 9, including at least one layer of a resin matrix material containing a plurality of carbon fibers aligned parallel to each other in a direction 90° to said longitudinal bore axis of said liner.

15. The gun barrel of claim 9 wherein said carbon fibers are graphite.

16. A tube for a gun barrel defining a longitudinal bore axis, comprising a plurality of elongate carbon fibers and a resin material surrounding said longitudinal bore axis, said elongate carbon fibers being aligned parallel with said longitudinal bore axis and under compression along said longitudinal bore axis.

17. The tube of claim 16 wherein said plurality of elongate carbon fibers surround an inner tubular metal liner.

18. The tube of claim 16 wherein said resin material is an epoxy resin.

19. The tube of claim 16, said tube having a muzzle end and a breech end and including a muzzle piece attached to said muzzle end and a breech piece attached to said breech end to compress said carbon fibers.

20. The tube of claim 16, including at least one layer of carbon fibers aligned parallel to each other in a direction 90° to said longitudinal bore axis.

21. The tube of claim 16, including at least one layer of a polymer.

22. The tube of claim 21 wherein said polymer is polypropylene.

* * * * *